United States Patent [19]

McCrary

[11] Patent Number: 4,505,465

[45] Date of Patent: Mar. 19, 1985

[54] WOOD SPLITTER'S AID TOOL

[76] Inventor: Frank R. McCrary, 6606 Wing Point Rd., Bainbridge Island, Wash. 98110

[21] Appl. No.: 482,849

[22] Filed: Apr. 7, 1983

Related U.S. Application Data

[63] Continuation-in-part of Ser. No. 249,380, Mar. 31, 1981, abandoned.

[51] Int. Cl.[3] ..... B25B 1/04

[52] U.S. Cl. ..... 269/130; 269/254 R; 24/19; 24/68 CT; 59/78; 144/366

[58] Field of Search ..... 24/19, 68 CD, 68 CT, 24/16 R, 365 CD, 265 A, 17 R, 17 A, 17 B; 269/130, 131, 254; D12/123; 59/78, 79 R, 93; 144/366

[56] References Cited

U.S. PATENT DOCUMENTS

| | | | |
|---|---|---|---|
| 1,972,346 | 9/1934 | Juline | 24/68 |
| 2,207,043 | 7/1940 | Weiss et al. | 59/78 |
| 2,540,888 | 2/1951 | Hyatt | 24/68 CD |
| 2,604,678 | 7/1952 | Mayes | 24/68 CT |
| 2,759,235 | 8/1956 | Rea | 24/68 CT |
| 2,942,127 | 6/1960 | Hanse | 24/19 |
| 2,966,878 | 1/1961 | Feiser, Jr. | 116/140 |
| 3,119,160 | 1/1964 | Hoppeler | 24/16 |
| 3,426,996 | 2/1969 | Broling | 24/68 CT |
| 3,482,393 | 12/1969 | Marshall | 59/35 |
| 3,504,404 | 4/1970 | Rehnstrom et al. | 24/16 |
| 3,669,439 | 6/1972 | Sanchez | 269/130 |
| 4,158,250 | 6/1979 | Ringwald | 24/16 R |

*Primary Examiner*—W. D. Bray

*Attorney, Agent, or Firm*—Graybeal & Cullom

[57] ABSTRACT

A wood splitter's aid tool comprising an elongated, elastically stretchable, flexible member comprising a length of metal chain in series with a length of elastic cord, with the cord and a portion of the length of chain protectively surrounded by a preferably precurved length of synthetic hose and having, at one end of the member, a hook adapted to engage a selected link of the chain in order to encircle a block of wood to be split with the member under tension. The encircling band allows the block of wood to be split by an axe and holds it in assembled condition against pieces flying off and against the necessity of a person risking one hand to hold a small remaining piece in place as the other hand wields an axe.

7 Claims, 3 Drawing Figures

WOOD SPLITTER'S AID TOOL

CROSS-REFERENCE TO RELATED APPLICATION

This application is a continuation-in-part of my copending U.S. application Ser. No. 06/249,380, filed Mar. 31, 1981, and entitled "AN ADJUSTABLE FLEXIBLE BAND", now abandoned.

BACKGROUND OF THE INVENTION

This invention relates to a device useful to persons splitting firewood, both to facilitate the work itself and to reduce the chances of injury to the user and to those standing nearby, and of damage to adjacent property. The invention is herein illustratively described by reference to the presently preferred form thereof; however, it will be recognized that certain modifications and changes therein with respect to details may be made without departing from the essential features involved.

With the increasing use of firewood in stoves, heaters and fireplaces for home heating, persons not familiar with the use of an axe to split wood are learning to do so. In the process, injuries to the user and to persons standing nearby are occurring from flying pieces of wood and from the blow of an axe glancing off a small remaining segment of wood to be split, or cutting a hand or wrist attempting to hold a small and unstable segment while the axe descends upon it. In addition, split pieces of wood flying from the chopping block present a problem in terms of potential property damage, and they also increase the labor of the user in gathering up the pieces afterwards for stacking or carrying into the area of the wood burner.

A broad object of this invention is to provide a means, preferably a highly simple and reliable means, easily used, that will not only save time, but will add materially to the safety of persons and property in the use of an axe to split wood.

More specifically, an object hereof is to devise a good wood splitter's aid tool which keeps the target, that is, the block of wood, intact as a large enough mass that it remains stable and does not require the user to employ his one hand to hold a remaining small piece in position on the chopping block while the axe is wielded with the other hand and also which minimizes the chances of a glancing blow of the axe deflecting against a nearby person or the user's own anatomy.

Furthermore, the invention keeps the split pieces of a block of wood together in a group for disposition after the splitting operation and thereby spares the user the task of gathering the pieces into an assemblage for stacking or hauling.

A specific object hereof is to devise a wood splitter's aid tool which is quickly and easily installed on a block of wood to be split and is easily removed from the assemblage of pieces of the block after splitting, a device which will not slip out of position during use, and a device which is designed to minimize the likelihood of nicking or damaging the blade of the axe in the event of a partial miss of the axe stroke.

SUMMARY OF THE INVENTION

In accordance with this invention, a wood splitter's aid tool is provided which comprises an elongated, elastically stretchable, flexible member preferably in the form of a metal chain connected serially with a length of elastically stretchable material, such as an elastic cord, and provided at one end with a hook or other fastening element that is engageable with any of successive links of the chain so as to encircle the block of wood to be split with the elongated member under tension. A length of synthetic hose or other soft frictional, protective material, such as polyethylene, slidably receiving and protectively surrounding the elastic portion and a substantial fraction of the length of chain is of a length to partially encircle the block when the aid tool is operatively positioned. It thereby helps protect the elastic cord, as well as the encircled portion of chain from the axe, and it also serves to hold the tensioned device against sliding down out of position intermediate the top and bottom ends of the block of wood as the axe is being used. Thus, the block, either in its initial integral condition or as it is split into a number of pieces, remains standing on the chopping block as a stable large target that is not easily missed by the axe, and it also remains in position as an assemblage of split pieces after the job is done so that the user may pick it up as an assemblage. This spares the chopper the necessity of gathering up scattered pieces and avoids running the risk of persons being injured by pieces flying from the chopping block in the usual procedure of chopping wood without such an aid tool.

A further specific feature of the novel aid tool resides in the use of a protective sheath in the form of an inherently precurved, polyethylene hose or the like which tends to curl around the block in the process of positioning the tool and thereby facilitates the quick installation of the aid tool on the block preparatory to using the axe. Such low cost polyethylene hose material, being molded to assume coiled configuration on the hardware store shelf, has this curvature inherently so as to make it suitable for purposes of the invention and available at low cost.

These and other features, objects and advantages of the invention will become more fully evident as the description proceeds with reference to the accompanying drawings.

DETAILED DESCRIPTION

Figure 2:
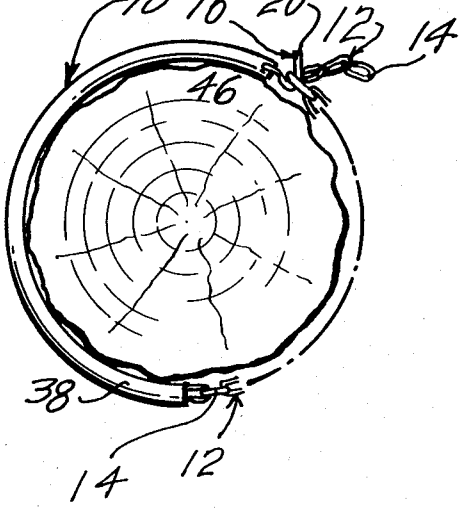
FIG. 2 is an end view of a block of wood, such as a length of tree trunk, with the aid tool in position preparatory to splitting the wood with an axe.

Referring to the drawings, the wood splitter's aid tool 10 comprises an elongated, elastically stretchable, flexible member which is adapted to encircle a length of firewood 46 (FIG. 2) to be placed on a chopping block and spit with an axe. The elongated member preferably comprises a length of chain 12 made up of successive links 14 of steel or other suitable metal and a length of elastic cord 22 having a first end 26 in which a loop 28 is formed and held by a clamp band 30 engaged with the eye 18 of an anchor hook 16. The opposite or second end 32 of the cord 22 forms a loop 34 around the adjacent end link of chain 12 and is held by a second clamp band 36, thereby connecting the elastic cord 22 in series with the chain 12 and the anchor hook 16.

Figure 1:
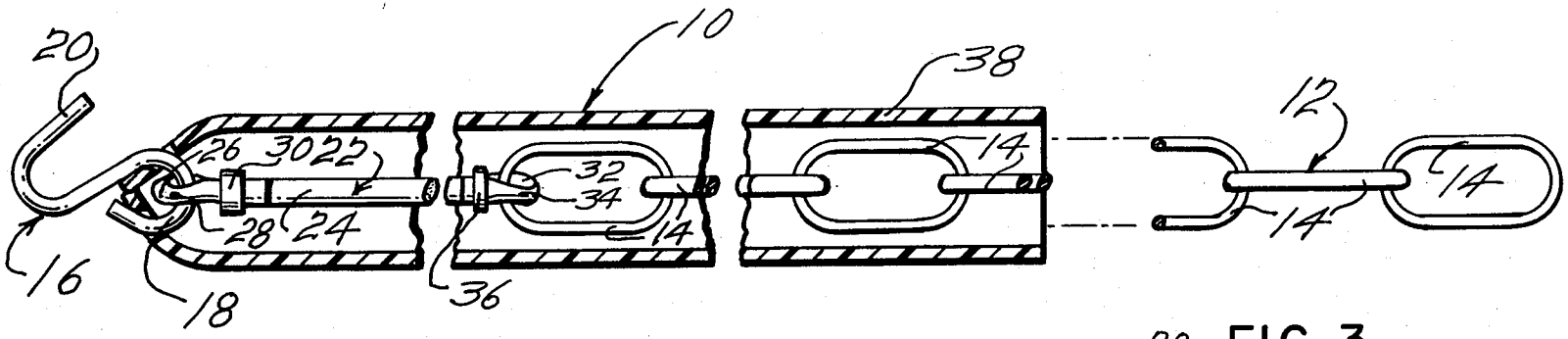
FIG. 1 is a side view with the aid tool stretched out in a straight line and with the protective sheath or hose shown in section.

A length of hose 38 of polyethylene or similar inexpensive, tough, soft frictional synthetic material extends over the eye 18 of the hook 16, the elastic cord 22, and an adjoining portion of the chain 12. In order to hold the length of protective hose in this position (i.e., adjoining the hook), two apertures are conveniently formed in the end of the hose through which the hook's eye 18 is threaded, as shown in FIG. 1. The length of hose protectively and slidably surrounds the elastic cord and a portion of the length of chain connected thereto. With the device installed as in FIG. 2, by stretching the chain and elastic cord under tension around the block of wood 46, the hose serves by its surface traction to hold the device against slipping down the block initially and during the splitting operation. As will be evident, the length of hose used for this purpose is selected to be less than the circumference of the smallest block of wood to be split so that a length portion of the chain projects from it in order to afford access to a link which can be engaged by the fastener hook 16 with the device in tension as depicted. Therefore, for the larger pieces of wood to be split, some of the chain will be exposed (i.e., not covered by the hose) to an axe. The user must be cautious, of course, if nicking of the axe or cutting of the chain is to be avoided for those pieces. Yet, it is the largest blocks that represent the larger axe targets and thus the problem of chain exposureis not unduly serious for the larger blocks to be split. If desired, during the process of splitting a block into pieces, the device may be shifted circumferentially so that the protected portion of the chain and the elastic cord will be nearest the user.

Figure 3:
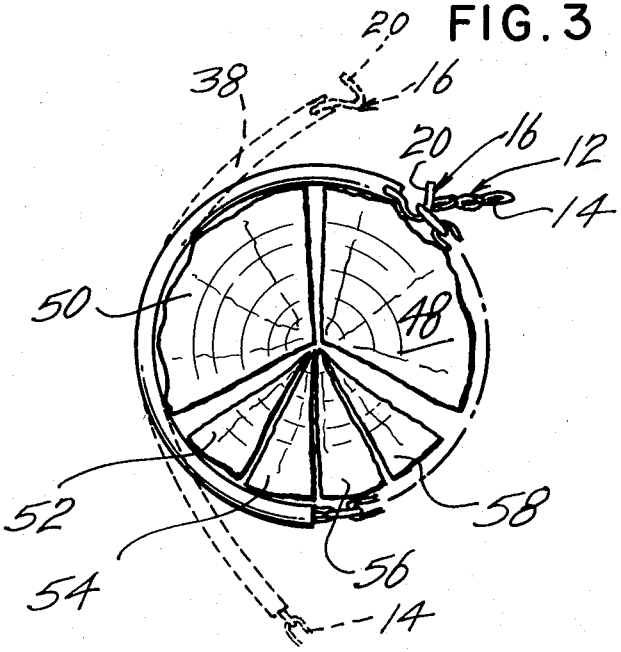
FIG. 3 is a view similar to FIG. 2 with the block partially split into segments and showing by dotted lines the positioning of the aid tool as it is being installed and as it is being removed from the block.

In the manufacture of the device 10, low cost, safety, simplicity and facility in use are key objectives. As a special feature, the protective length of hose 38 that surrounds the elastic cord 22 and a portion of the chain 12 is selected of conventional manufactured hose of polyethylene or similar soft and tractional hose material which has a natural coil or curvature as it is produced and marketed. In this way, the user raising the aid tool 10 into position to encircle a block of wood finds that the device already tends to assume enwrapment curvature shown by dotted lines in FIG. 3 and is thereby aided considerably in fastening it in working position on the wood. Once the block is split, as is partially shown in FIG. 3, it is held together as an assemblage of pieces 45, 50, 52, 54, 56, and 58 for disposition suiting the purpose of the user. During splitting, the assemblage remains a large axe target with little danger of the axe glancing off a small piece and injuring a person or property. The pieces, of course, themselves do not fly off and risk breaking windows or injuring persons as the block is being split into pieces. Even more critical, the risk of the user chopping a hand use to hold a remaining small piece on the block as the axe descends is completely avoided.

In practice, it is desirable to employ an elastic cord 22 which will stretch as much as ten inches to twelve inches for most firewood splitting applications. Common stretchable shock cord serves ideally since its fabric exterior is freely slidable inside the protector hose. The composite length of the flexible, elongated member typically will be of the order of three feet with the band relaxed or contracted. An inexpensive steel chain may be used since it is not required to carry heavy loads, but only to remain intact and to withstand occasional axe blows sufficiently to yield to the impact. The positioning of the band around the block of wood should be such that the band has substantially more remaining stretchability than is taken up in initial tensioning of the band around the block so that as the block splits, the axe may enter between the partly split surfaces without undue resistance due to constriction tension. Typically a three-quarter inch hose of polyethylene or similar material is suitable for the sheath 38. The chain 12 should be of a size which will side readily within the hose. The device 10 is compact and light in weight, as well as durable and inexpensive to produce.

These and other aspects of the invention will become evident based on the foregoing description and illustration of the presently preferred embodiment thereof.

The embodiments of the invention in which an exclusive property or privilege is claimed are as follows:

1. A wood splitter's aid tool comprising:

(a) an elongated, elastically stretchable, flexible member adapted to encircle a length of firewood to be split with an axe, said elongated member comprising a stretchable elastic cord element connected serially with a length of a chain;

(b) said elastic cord element having a fastener element on one end adapted to releasably engage said chain at a selected point, of a plurality of such points, along the length of said chain intermediate the ends thereof, so that said elongated member under elastic tension may tightly encircle the length of firewood yet have further elastic yieldability in said elastic cord element of said elongated member; and (c) a flexible tubular sheath of non-slip material lengthwise through which at least a portion of the length of said stretchable elastic cord element extends protected, said flexible tubular sheath adapted to be pressed by tension in the elongated member against the side of the firewood being split so as to reduce a tendency of the encircling elongated member to slide down the firewood.

2. The aid tool defined in claim 1, wherein the fastener element comprises a hook-like element selectively engageable with any of successive lengths of the chain.

3. The aid tool defined in claim 2, wherein the flexible tubular sheath surrounds and extends the entire length of the elastic cord element and over a portion of the length of said chain.

4. The aid tool defined in claim 1 or 2, wherein the flexible tubular sheath comprises a length of synthetic hose having a natural longitudinal curvature tending partly to enwrap the length of firewood when positioning the said tool thereon.

5. The aid tool defined in claim 2, wherein the flexible tubular sheath surrounds and extends the entire length of the elastic cord element and over a portion of the length of said chain, said hook-like element having a portion threaded through wall apertures in the adjacent end of the sheath to hold it against slipping away from such hook-like element.

6. The aid tool defined in claim 5, wherein the flexible tubular sheath comprises a length of synthetic hose having a natural longitudinal curvature tending partly to enwrap the length of firewood when positioning the aid tool thereon.

7. The aid tool defined in claim 1, wherein the elongated member comprises a length of steel chain connected serially with a length of stretchable shock cord, and wherein the tubular sheath comprises a length of synthetic hose longer than the unstretched shock cord and shorter than the combined lengths of the unstretched shock cord and the chain.

* * * * *